US009103560B2

(12) United States Patent
Dempsey et al.

(10) Patent No.: US 9,103,560 B2
(45) Date of Patent: Aug. 11, 2015

(54) FURNACE VENT WITH WATER-PERMEABLE INNER PIPE

(75) Inventors: Daniel J. Dempsey, Carmel, IN (US); Michael L. Brown, Greenwood, IN (US)

(73) Assignee: Carrier Corporation, Farmington, CT (US)

( * ) Notice: Subject to any disclaimer, the term of this patent is extended or adjusted under 35 U.S.C. 154(b) by 511 days.

(21) Appl. No.: 13/038,084

(22) Filed: Mar. 1, 2011

(65) Prior Publication Data

US 2011/0247603 A1 Oct. 13, 2011

Related U.S. Application Data

(60) Provisional application No. 61/322,554, filed on Apr. 9, 2010.

(51) Int. Cl.

| | |
|---|---|
| ***F24H 8/00*** | (2006.01) |
| ***F24H 3/02*** | (2006.01) |
| ***F24H 9/00*** | (2006.01) |

(52) U.S. Cl.

CPC ..... *F24H 3/025* (2013.01); *F24H 9/0084* (2013.01); *F24D 2220/06* (2013.01)

(58) Field of Classification Search

CPC ..... F24H 8/00; F24H 8/003
USPC ..... 126/85 B, 99 R, 113, 117
See application file for complete search history.

(56) References Cited

U.S. PATENT DOCUMENTS

| | | | | |
|---|---|---|---|---|
| 2,989,047 | A * | 6/1961 | Olson | 126/113 |
| 3,614,949 | A * | 10/1971 | Goodgion | 126/80 |
| 3,860,384 | A | 1/1975 | Vulliet et al. | |
| 4,262,608 | A * | 4/1981 | Jackson | 110/162 |
| 4,712,515 | A | 12/1987 | Couprie | |
| 4,940,042 | A * | 7/1990 | Moore et al. | 122/18.2 |
| 5,282,456 | A | 2/1994 | Smelcer et al. | |
| 5,738,023 | A | 4/1998 | Mennink | |
| 7,624,788 | B2 * | 12/2009 | Brown et al. | 165/83 |
| 7,972,416 | B2 * | 7/2011 | Wang et al. | 95/52 |
| 2005/0236138 | A1 * | 10/2005 | Brown et al. | 165/46 |
| 2009/0205490 | A1 * | 8/2009 | Wang et al. | 95/52 |
| 2009/0241814 | A1 | 10/2009 | Bentzen | |
| 2011/0169177 | A1 * | 7/2011 | Wang et al. | 261/128 |

FOREIGN PATENT DOCUMENTS

| | | | | |
|---|---|---|---|---|
| WO | WO 9636840 | A1 * | 11/1996 | F24H 8/00 |
| WO | WO 2008/076166 | A1 | 6/2008 | |
| WO | WO 2009/105173 | A1 | 8/2009 | |

* cited by examiner

*Primary Examiner* — Jorge Pereiro
(74) *Attorney, Agent, or Firm* — Miller, Matthias & Hull LLP

(57) ABSTRACT

A vent system for improving the efficiency and/or reducing emissions of a combustion device is disclosed. The vent system may include an outer pipe and an inner pipe having a longitudinal section that is permeable to water or water vapor and is longitudinally disposed within the outer pipe. The inner pipe defines a first passageway and the outer and inner pipes define a second passageway therebetween. As the moisture and/or heat are transferred from the flue gas to the intake air through the longitudinal section of the inner pipe, the efficiency of the furnace may be improved and the NOx emission of the furnace may be reduced.

20 Claims, 3 Drawing Sheets

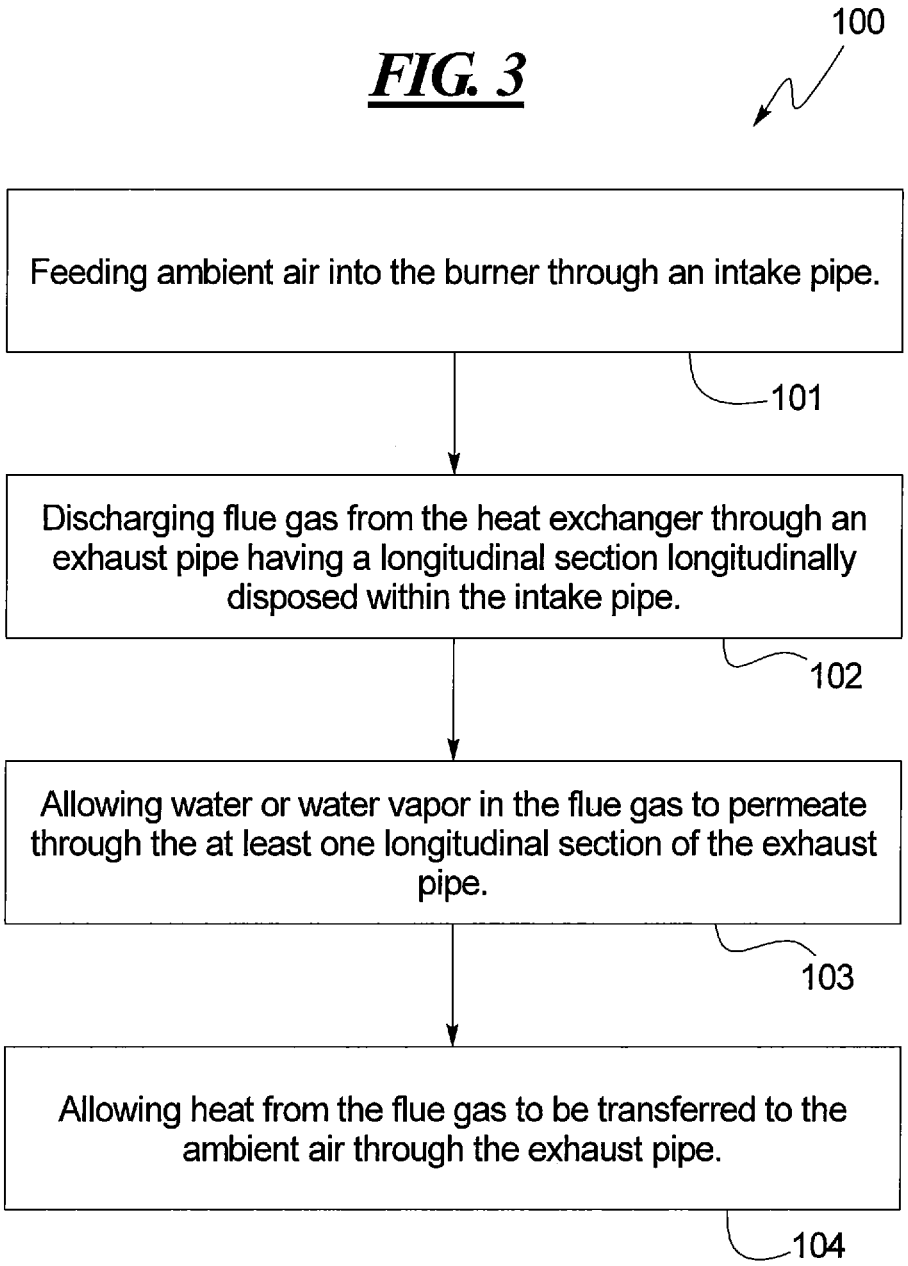
FIG. 3
100
Feeding ambient air into the burner through an intake pipe.
101
Discharging flue gas from the heat exchanger through an exhaust pipe having a longitudinal section longitudinally disposed within the intake pipe.
102
Allowing water or water vapor in the flue gas to permeate through the at least one longitudinal section of the exhaust pipe.
103
Allowing heat from the flue gas to be transferred to the ambient air through the exhaust pipe.
104

FURNACE VENT WITH WATER-PERMEABLE INNER PIPE

CROSS-REFERENCE TO RELATED APPLICATIONS

This is a non-provisional U.S. patent application, which claims priority under 35 U.S.C. §119(e) to U.S. Provisional Patent Application Ser. No. 61/322,554 filed on Apr. 9, 2010, the entirety of which is incorporated by reference herein.

TECHNICAL FIELD OF THE DISCLOSURE

This disclosure generally relates to a method and apparatus for improving the efficiency and/or reducing emissions of a furnace and more particularly relates to the use of a furnace vent system with a water permeable and/or heat conductive inner pipe disposed within an outer pipe to pre-moisten and/or pre-heat intake air before it is fed into a burner.

BACKGROUND OF THE DISCLOSURE

Combustion devices based on hydrocarbon fuels are widely used to provide thermal, mechanical or electric energies. For example, fireplaces, ovens, furnaces, and boilers have been installed and used in commercial and residential buildings to provide heat, hot water, and other conveniences. Ideally, complete combustion occurs when hydrocarbon compounds in the fuel exothermically react with oxygen in the air to produce water vapor and carbon dioxide. Furnace systems are designed to run the combustion reaction with an excess of oxygen so that complete combustion can take place and maximum amount of heat may be released from hydrocarbon fuels.

A conventional condensing furnace system for a residential building typically includes a burner operatively connected to a heat exchanger, a combustion air intake pipe operatively connected to the burner, and an exhaust pipe operatively connected to the heat exchanger by way of a draft inducer. In use, ambient air from outside of the building is induced into the furnace system through the intake pipe that extends through a building wall. The induced intake air is then fed into the burner, where the hydrocarbon fuel is injected and entrenched in the induced intake air. The fuel-air mixture is then combusted to produce a flame that flows into the heat exchanger, where the heat generated from the combustion is transferred to another medium (air or water to be heated). The exhaust gas (flue gas) is then discharged from the heat exchanger to outside of the building through the exhaust pipe, also extending through a building wall.

The intake and exhaust pipes may be integrated into a compact tube-within-tube design for easier installation and/or cost and space saving. For example, the exhaust pipe may be concentrically disposed within the intake pipe. As a result, while flue gas is discharged through the exhaust pipe, ambient air is induced into the furnace system through the annular space between the intake and exhaust pipes. As the intake and exhaust pipes are generally made of Polyvinyl Chloride (PVC) or other gas impermeable material, no substance is transferred between the intake air and flue gas.

On the other hand, the intake and exhaust pipes may also have a side-by-side configuration to improve the efficiency of the furnace by promoting heat exchange between the intake air and flue gas, i.e. pre-heating of the intake air by the flue gas. To that end, a membrane module may be disposed between the intake and exhaust pipes to promote heat exchange therebetween. The membrane module may also simultaneously allow moisture exchange between the intake air and flue gas. The moisture exchange may also reduce $NO_x$ emission of the furnace.

However, the construction of the membrane module is relatively complicated and requires, for example, an array of parallel exhaust tubes made of a hydrophobic polymeric material and orthogonally disposed in the flow path of the intake air. Accordingly, the membrane only extends along a small section of the intake and exhaust pipes. As a result, the heat and/or moisture exchange capacities of the membrane module are limited. Moreover, the membrane module requires circulation of a moisture absorbent, such as a hygroscopic liquid like ethylene glycol, which not only increases manufacturing and maintenance costs of the furnace system but may also cause undesirable noises as the flowing intake air and/or flue gas interacts with the hygroscopic liquid.

Hence, there is a need for a vent for a combustion device that combines the intake and exhaust pipes into a compact and easy to install apparatus while improving the efficiency of the combustion device and/or reducing emission of same. Further, there is a need for a furnace vent with simple construction and low maintenance (i.e. no complex membrane module design or hygroscopic agent).

SUMMARY OF THE DISCLOSURE

In satisfaction of the aforementioned needs, an improved vent system for a combustion device is disclosed. The vent system may include an outer pipe and an inner pipe having a longitudinal section that is permeable to water or water vapor and is longitudinally disposed within the outer pipe. The inner pipe defines a first passageway and the outer and inner pipes define a second passageway therebetween.

In another aspect of this disclosure, an improved furnace system is disclosed. The furnace system may include a burner unit in operative connection with a heat exchanger unit, an intake pipe in operative connection with and conveying ambient air to the burner unit, and an exhaust pipe in operative connection with and conveying flue gas from the heat exchanger unit. The exhaust pipe has a longitudinal section that is permeable to water or water vapor and is longitudinally disposed within the intake pipe.

In yet another aspect of this disclosure, a method of improving efficiency of a furnace having a burner unit in operative connection with a heat exchanger unit is disclosed. The method may include the steps of feeding ambient air into the burner unit through an intake pipe, discharging flue gas from the heat exchanger through an exhaust pipe having a longitudinal section longitudinally disposed within the intake pipe, and allowing water or water vapor in the flue gas to permeate through the at least one longitudinal section of the exhaust pipe.

Other advantages and features of the disclosed apparatus and method of use thereof will be described in greater detail below. It will also be noted here and elsewhere that the apparatus or method disclosed herein may be suitably modified to be used in a wide variety of applications by one of ordinary skill in the art without undue experimentation.

BRIEF DESCRIPTION OF THE DRAWINGS

For a more complete understanding of the disclosed apparatus and method, reference should be made to the embodiments illustrated in greater detail in the accompanying drawings, wherein:

FIG. 3 is a block diagram of a method for improving efficiency of a furnace having a burner unit in operative connection with a heat exchanger unit according to another aspect of this disclosure.

It should be understood that the drawings are not necessarily to scale and that the disclosed embodiments are sometimes illustrated diagrammatically and in partial views. In certain instances, details which are not necessary for an understanding of the disclosed device or method which render other details difficult to perceive may have been omitted. It should be understood, of course, that this disclosure is not limited to the particular embodiments illustrated herein.

DETAILED DESCRIPTION OF THE DISCLOSURE

Figure 1:
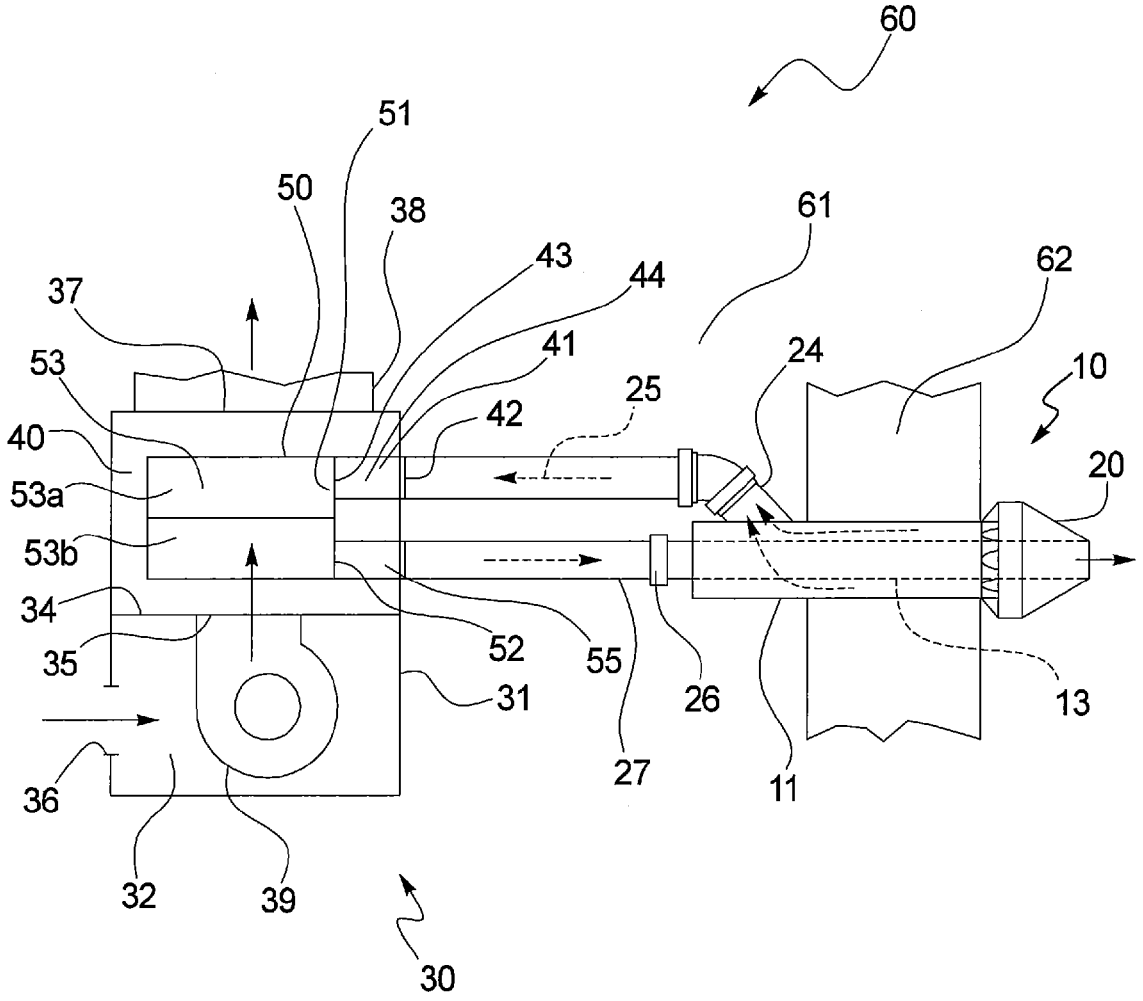
FIG. 1 is a schematic illustration of a fuel-fired induced draft furnace utilizing an improved furnace vent in accordance with this disclosure.

Referring now to FIG. 1, an exemplary embodiment of an improved vent system generally referred to by reference numeral 10 is schematically illustrated. As disclosed herein, the vent system 10 may be use in conjunction with a combustion device, such as a fuel-fired induced draft furnace 30. However, the combustion device may also be a boiler, water heater, or other suitable fuel-combusting space or water heating device. Furnace 30 may be located in a commercial or residential building 60 having an enclosed interior space 61 separated from air outside of the building 60 through a wall 62.

In this disclosure, "intake air" refers to outside air that is drawn into the furnace 30 through the vent system 10 before it is combusted. "Flue gas" refers to the combustion exhaust gas produced by the furnace 30. The composition of the flue gas generally depends on the type of fuel combusted, but usually consists of mostly nitrogen (typically more than two-thirds) derived from the combustion air, carbon dioxide ($CO_2$) and water vapor as well as excess oxygen (also derived from the combustion air). It may further contain a small percentage of pollutants such as particulate matter, carbon monoxide, nitrogen oxides ($NO_x$) and sulfur oxides.

As illustrated in FIG. 1, the furnace 30 includes a housing 31 vertically divided into a blower compartment 32 and a heating chamber 40 by a horizontal interior panel 34 having a central opening (also referred to herein as a divider panel opening) 35 therein. A circulating air inlet 36 may be formed in a bottom section of the housing 31 to feed house air into the blower compartment 32. A supply air outlet 37 may be formed in the top section of the housing 31 and connected to supply air duct 38 to convey heated air to desired locations within the building 60. A supply air blower 39 is positioned in the blower compartment 32 and has its outlet connected to the central opening 35.

The heating chamber 40 may include a burner unit 41 and a heat exchanger unit 50 operatively connected to the burner unit 41. The burner unit 41 may include a combustion air inlet 42 and an air outlet 43 defining a fuel-air mixing chamber 44 therebetween. The combustion air inlet 42 is in operative connection with and receives intake air from the disclosed vent system 10. The burner unit 41 may also include an igniter and a fuel injector (not shown) that sprays a hydrocarbon fuel into the fuel-air mixing chamber 44, where the fuel is entrenched in and mixed with the intake air before the mixture is ignited by the igniter to produce a flame.

The heat exchanger unit 50 may include an inlet 51, and outlet 52, and one or more heat exchangers 53 therebetween. Each of the one or more heat exchangers 53 may be positioned in parallel or serially connected to each other. The heat exchanger unit 50 can be operatively connected to the burner unit 41 so that the flame and/or hot flue gas produced in the burner unit 41 flows into the one or more heat exchangers 53 through the inlet 51 of the heat exchanger unit 50. The outlet 52 is in operative connection with and conveys flue gas to the disclosed vent system 10. In the embodiment illustrated in FIG. 1, the heat exchanger unit 50 includes an upper heat exchanger **53*a* connected in series to a lower heat exchanger 53*b*, both of which are securely supported in the heating chamber 40. The furnace 30 may also include a draft-inducing fan 55 to draw the intake air into the burner unit 41. As illustrated in FIG. 1, the draft-inducing fan 55 may be operatively connected to the outlet 52 of the heat exchanger unit 50** although other suitable locations for the inducing may also be used.

In operation, the intake combustion air is induced into the burner unit 41 through the vent system 10 and the air inlet 42 by the draft-inducing fan 55, where the intake air is mixed with the fuel injected through the fuel injector. The fuel/air mixture is ignited to produce a flame and flue gas, which subsequently flows into the inlet 51 of the heat exchanger unit 50. The draft-inducing fan 55 draws the flue gas and/or flame sequentially through the upper and lower heat exchanger sections (**53*a*, 53*b*) and then discharges the cooled flue gas through the outlet 52 of the heat exchanger unit 50 and the vent system 10. Return air from the interior space 61 of the building 60 served by the furnace 30 is drawn into the blower compartment 32, through the inlet opening 36, by the blower 39 and then forced upwardly across the heat exchanger unit 50 to create heated supply air, which is then delivered to the conditioned space through the supply air duct 38**.

Figure 2:
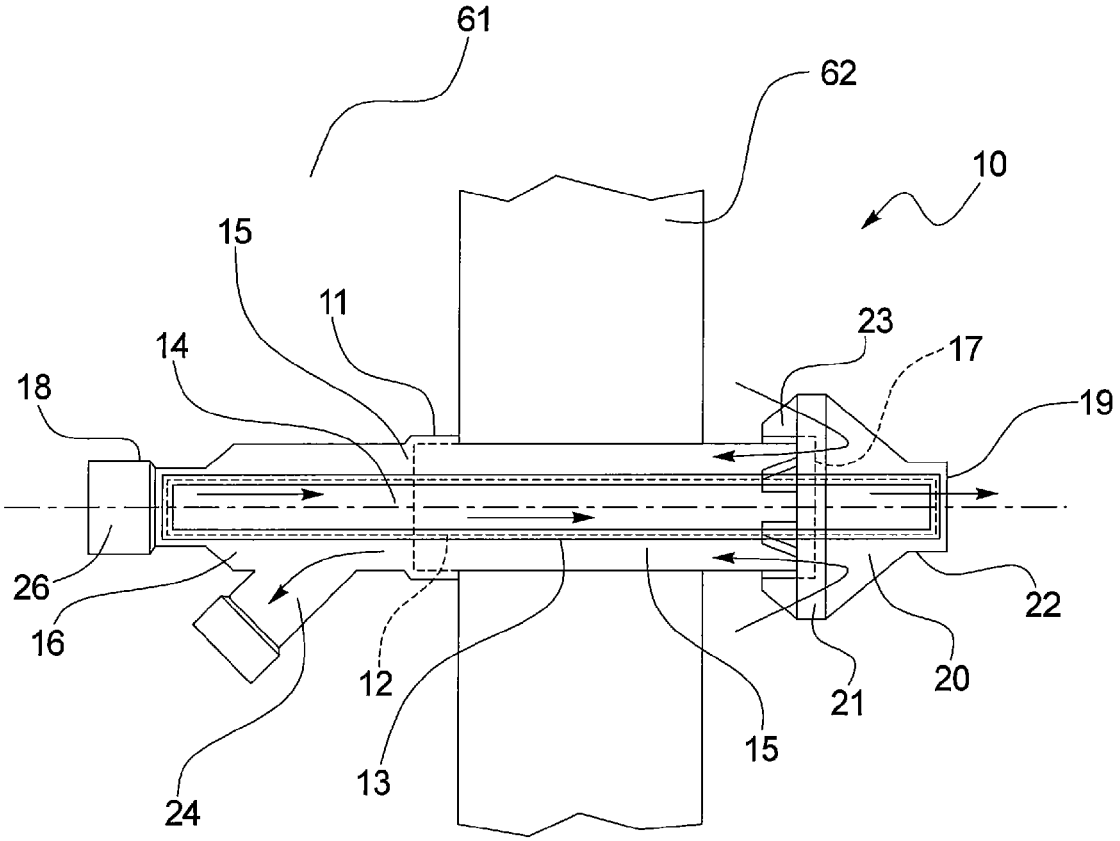
FIG. 2 is an enlarged side view of the furnace vent shown in FIG. 1.

Turning to FIG. 2, the disclosed vent system 10 may include an outer pipe 11 and an inner pipe 12. The inner pipe 12 includes at least one longitudinal section 13 that is permeable to water or water vapor and is longitudinally disposed within the outer pipe 11. The inner pipe 12 defines a first passageway 14 and the outer and inner pipes (11, 12) define a second passageway 15 therebetween. In general, the vent system 10 is operatively connected to the furnace 30 to supply intake air to and discharge flue gas from the furnace. In the embodiment illustrated in FIG. 1, the second passageway 15 is in operative connection with, and conveys intake air to, the burner unit 41; and the first passageway 14 is in operative connection with, and conveys flue gas from, the heat exchanger unit 50. However, it is to be understood that FIG. 1 only illustrates a non-limiting embodiment of the operative connection between the vent system 10 and furnace 30. In other embodiments, the first passageway 14 may be in operative connection with, and convey intake air to, the burner unit 41; and the second passageway 15 may be in operative connection with, and convey flue gas from, the heat exchanger unit 50.

The outer pipe 11 extends between a proximal end 16 disposed inside of the wall 62 and a distal end 17 disposed outside of the wall 62. Similarly, the inner pipe 12 also extends between a proximal end 18 disposed inside of the wall 62 and a distal end 19 disposed outside of the wall 62. The inner pipe 12 includes the longitudinal section 13 that is longitudinally disposed within the outer pipe 11. For the purpose of this disclosure, the term "proximal" refers to a direction closer to the furnace 30 and the term "distal" refers to a direction further away from the furnace 30. Moreover, the term "longitudinally disposed within" in this disclosure refers to an orientation in which an inner pipe extends within an outer pipe in a direction that is substantially parallel to but not necessarily coaxial with the outer pipe.

Thus, although the longitudinal section 13 of the inner pipe 12 is shown in FIG. 2 as being concentric with the outer pipe 11, it should not be considered as limiting the scope of this disclosure. In other embodiments, the longitudinal section 13 may be parallel and off-centric to the outer pipe 11 or even slightly oblique to the outer pipe 11. Moreover, more than one longitudinal section 13 may be used in the vent system 10. For example, a plurality of parallel longitudinal sections 13 convergently connected to the proximal and distal ends (18, 19) of the inner pipe 12 may be used in some embodiments (not shown in the drawings). Without wishing to be bounded by any particular theory, it is contemplated that the orientation of the longitudinal section 13 disclosed herein not only allows easier construction and maintenance, but more importantly, it provides larger surface area and longer contact time for the moisture and/or heat transfer between the intake air and flue gas. In addition, the orientation of the longitudinal section 13 disclosed herein obviates the need for a hygroscopic liquid or other moisture absorbent that circulates between the intake air and flue gas, thereby not only allowing easier construction and maintenance, but also preventing noise associated with the interaction between flowing gas and liquid.

In order to prevent undesirable matter such as rain, snow, animal, or other debris from entering the vent through the second passageway 15, the vent system 10 may include an optional intake cover 20 to block such unwanted matter while allowing intake air to be drawn into the second passageway 15. As illustrated in FIG. 2, the intake cover 20 can include a frusto-conical wall extending between a proximal end 21 and a distal end 22. The intake cover 20 can also include a plurality of clamps 23 proximally extending from the circumference of the proximal end 21 for securely engaging the distal end 17 of the outer pipe 11. The distal end 22 of the cover 20 may be securely connected to the distal end 19 of the inner pipe 12, such as through frictional engagement. An additional cover (not shown) may also be provided to the first passageway 14, especially in the embodiments in which the first passageway 14 is used to convey intake air.

In the embodiment illustrated in FIG. 2, the vent system 10 is horizontal and perpendicularly extends through the wall 62. This orientation should not be construed as limiting the scope of this disclosure. In other embodiments, the vent system 10 may extend through the wall 62 at an acute or obtuse angle. In addition, the vent system 10 may be vertically oriented and extending through the roof instead of a sidewall of the building 60.

To facilitate the transfer of moisture from the flue gas to intake air, the longitudinal section 13 of the inner pipe 12 may be made of a water permeable material. In one embodiment, the longitudinal section 13 may be made of a nanoporous ceramic material, which allows water or water vapor to permeate through via capillary condensation. In another embodiment, the longitudinal section 13 may be made of a polymeric material such as an ionomer known as Nafion®, which is a sulfonated tetrafluoroethylene based fluoropolymer-copolymer. Features of Nafion® include high temperature-endurance (up to 190° C.), chemical resistance, and water permeability based on temperature and pressure. In some embodiment, the entire inner pipe 12 is made of the water permeable material for simplicity of design and manufacturing. In other embodiments, only the longitudinal section 13 of the inner pipe 12 that separates the flue gas from the intake air can be made of the water permeable material. The longitudinal section 13 may also allow transfer of heat from the flue gas to intake air.

In order to prevent undesirable corrosion to the outer pipe 11 and the furnace 30, the longitudinal section 13 may block corrosive gas components of the flue gas while allowing water or water vapor to pass through. In one embodiment, the longitudinal section 13 only allows water or water vapor to be transferred to the intake air while blocking all other components of the flue gas. Moreover, while the longitudinal section 13 or in some embodiments the entire inner pipe 12 is made of the water permeable material, the rest of the vent system 10 may be conveniently made of a durable and inexpensive material such as PVC or other suitable plastic, metal or composite material generally used in furnace vents.

Referring now to FIGS. 1 and 2, the vent system 10 is operatively connected to the furnace 30 to supply intake air to the burner unit 41 and to discharge flue gas from the heat exchanger unit 50. To that end, the outer pipe 11 includes a distal outlet port 24, which may be connected to the burner unit 41 through an intake air duct 25. Similarly, the inner pipe 12 also includes a distal inlet port 26, which may be connected to the heat exchanger unit 50 through a flue gas duct 27.

During operation of the furnace 30, the draft-inducing fan 55 draws intake air into the burner unit 41 sequentially through the first passageway 15, the distal outlet port 24, and the intake air duct 25. At the same time, the draft-inducing fan 55 discharges cooled flue gas sequentially through the flue gas duct 27, the distal inlet port 26, and the second passageway 14. Because the moisture and/or heat are transferred from the flue gas to the intake air through the longitudinal section 13 of the inner pipe 12, pre-humidification of the combustion air (e.g., intake air) occurs, resulting in increased efficiency of the furnace. Moreover, the additional humidity also reduces $NO_x$ emissions of the furnace as a result.

INDUSTRIAL APPLICABILITY

In accordance with another aspect of this disclosure, a method of improving efficiency of a furnace having a burner in operative connection with a heat exchanger is disclosed. As schematically illustrated in FIG. 3, the method 100 may include a step 101 of feeding ambient air into the burner through an intake pipe, a step 102 for discharging flue gas from the heat exchanger through an exhaust pipe having a longitudinal section longitudinally disposed within the intake pipe, and a step 103 for allowing water or water vapor in the flue gas to permeate through the at least one longitudinal section of the exhaust pipe. The method 100 may further include an optional step 104 for allowing heat from the flue gas to be transferred to the ambient air through the exhaust pipe.

Although the vent system 10 is used in conjunction with a fuel-fired induced draft condensing furnace 30 in the non-limiting embodiments described and illustrated herein, the vent may also be used with other combustion devices such as be fireplaces, ovens, boilers, steam generators, etc.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. A vent system for a combustion device, comprising:

an outer pipe; and an inner pipe substantially made of a nanoporous ceramic material that is permeable to water or water vapor and having a plurality of substantially parallel longitudinal sections that are longitudinally disposed within the outer pipe, the inner pipe defining a first passageway, the outer and inner pipes defining a second passageway therebetween, flue gas being conveyed by one of the first passageway or the second passageway, intake air being conveyed by one of the first passageway or the second passageway, the flue gas and intake air being conveyed by different passageways, where water or water vapor is transferred from the flue gas to the intake air through the inner pipe, the inner pipe further substantially made of a nanoporous ceramic material that is impermeable to corrosive gas components of the flue gas.

2. The vent system of claim 1, wherein flue gas is conveyed in the first passageway and intake air is conveyed in the second passageway.

3. The vent system of claim 1, wherein the inner pipe is heat conductive.

4. The vent system of claim 1, wherein the outer pipe extends horizontally.

5. The vent system of claim 1, wherein the outer pipe extends between a proximal end disposed within an enclosed space and a distal end disposed outside of the enclosed space.

6. The vent system of claim 1, wherein the inner pipe terminates into a distal end that is disposed outside of the outer pipe.

7. The vent system of claim 1, wherein the outer pipe is substantially impermeable to water or water vapor.

8. The vent system of claim 1, wherein the water permeable material further comprises an ionomeric material.

9. The vent system of claim 1, wherein the outer and inner pipes are concentric.

10. A furnace system, comprising:

a burner unit in operative connection with a heat exchanger unit;

an intake pipe in operative connection with and conveying ambient air to the burner unit; and an exhaust pipe in operative connection with and conveying flue gas from the heat exchanger unit, the exhaust pipe substantially made of a nanoporous ceramic material that is permeable to water or water vapor and made of a nanoporous ceramic material that is impermeable to corrosive gas components of the flue gas and having a plurality of substantially parallel longitudinal sections that are longitudinally disposed within the intake pipe, and where water or water vapor is transferred from the flue gas to the ambient air.

11. The furnace system of claim 10, wherein the exhaust pipe is heat conductive.

12. The furnace system of claim 10, wherein the intake pipe extends horizontally.

13. The furnace system of claim 10, wherein the intake pipe extends between a proximal end disposed within an enclosed space and a distal end disposed outside of the enclosed space.

14. The furnace system of claim 10, wherein the exhaust pipe terminates into a distal end that is disposed outside of the intake pipe.

15. The furnace system of claim 10, wherein the intake pipe is substantially impermeable to water or water vapor.

16. The furnace system of claim 10, wherein the water permeable material further comprises an ionomeric material.

17. The furnace system of claim 10, wherein the intake and exhaust pipes are concentric.

18. A method of improving efficiency of a furnace having a burner in operative connection with a heat exchanger, the method comprising:

feeding intake air into the burner through an intake pipe;

discharging flue gas from the heat exchanger through an exhaust pipe having a plurality of substantially parallel longitudinal sections longitudinally disposed within the intake pipe; and allowing water or water vapor in the flue gas to permeate through the longitudinal section of the exhaust pipe into the intake air while preventing corrosive gas components in the flue gas to permeate through the longitudinal section of the exhaust pipe, the longitudinal section of the exhaust pipe comprising a nanoporous ceramic material.

19. The method of claim 18, further comprising allowing heat from the flue gas to be transferred to the ambient air through the exhaust pipe.

20. The method of claim 18, wherein the longitudinal section of the exhaust pipe further comprises an ionomeric material.

* * * * *